United States Patent [19]

Kobayashi

[11] Patent Number: 5,072,394

[45] Date of Patent: Dec. 10, 1991

[54] METHOD AND APPARATUS FOR PROVIDING IGNITION TIMING ALARM FOR INTERNAL COMBUSTION ENGINE

[75] Inventor: Yoshiyuki Kobayashi, Shizuoka, Japan

[73] Assignee: Suzuki Jidosha Kogyo Kabushiki Kaisha, Shizuoka, Japan

[21] Appl. No.: 477,601

[22] Filed: Feb. 9, 1990

[30] Foreign Application Priority Data

Feb. 21, 1989 [JP] Japan ..... 1-41435

[51] Int. Cl.[5] ..... F02P 5/08

[52] U.S. Cl. ..... 364/431.03; 123/479

[58] Field of Search ..... 364/431.03, 431.06; 73/116, 117.2, 117.3; 324/391, 392; 123/416–418, 479

[56] References Cited

U.S. PATENT DOCUMENTS

| | | | |
|---|---|---|---|
| 4,255,789 | 3/1981 | Hartford et al. | 364/431.06 |
| 4,331,029 | 5/1982 | Wilson | 324/391 |
| 4,426,973 | 1/1984 | Nakano et al. | 123/416 |
| 4,467,763 | 8/1984 | Gillespie et al. | 73/116 |
| 4,472,779 | 9/1984 | Marino et al. | 324/391 |
| 4,502,446 | 3/1985 | Kanegae et al. | 123/479 |
| 4,602,127 | 7/1986 | Neely et al. | 364/431.03 |
| 4,718,014 | 1/1988 | Kobayashi et al. | 123/416 |

OTHER PUBLICATIONS

"Tacho/dwell Meter for Engine Tune-ups", Electronics Magazine Article by Swain; Oct. 1980, vol. 42 No. 7.

*Primary Examiner*—Salvatore Cangialosi

*Attorney, Agent, or Firm*—Flynn, Thiel, Boutell & Tanis

[57] ABSTRACT

An ignition timing alarm device is provided for an internal combustion engine which includes an electronic ignition timing control arrangement for electronically controlling the ignition timing. A control arrangement is provided for memorizing the input of a fixed ignition timing command signal in order to subsequently issue a warning at a checking time if the vehicle ran at a speed exceeding a preset speed in a state where the ignition timing was controlled to be the fixed ignition timing in accord with the input of the fixed ignition timing command signal.

4 Claims, 2 Drawing Sheets

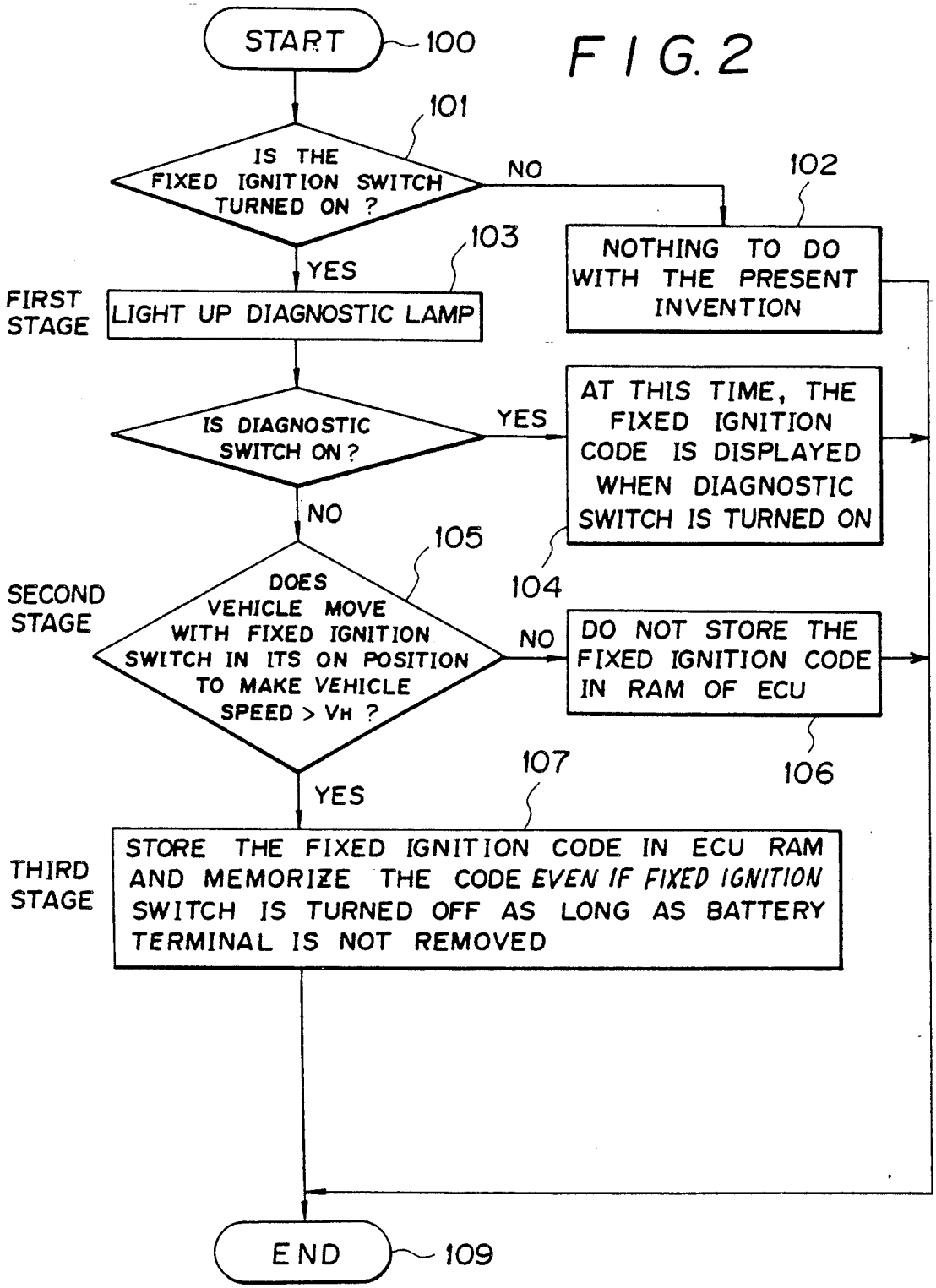
FIG. 2
START
100
101
IS THE FIXED IGNITION SWITCH TURNED ON ?
NO
102
NOTHING TO DO WITH THE PRESENT INVENTION
YES
103
FIRST STAGE
LIGHT UP DIAGNOSTIC LAMP
IS DIAGNOSTIC SWITCH ON ?
YES
AT THIS TIME, THE FIXED IGNITION CODE IS DISPLAYED WHEN DIAGNOSTIC SWITCH IS TURNED ON
104
NO
105
SECOND STAGE
DOES VEHICLE MOVE WITH FIXED IGNITION SWITCH IN ITS ON POSITION TO MAKE VEHICLE SPEED > VH ?
NO
DO NOT STORE THE FIXED IGNITION CODE IN RAM OF ECU
106
YES
107
THIRD STAGE
STORE THE FIXED IGNITION CODE IN ECU RAM AND MEMORIZE THE CODE EVEN IF FIXED IGNITION SWITCH IS TURNED OFF AS LONG AS BATTERY TERMINAL IS NOT REMOVED
END
109

METHOD AND APPARATUS FOR PROVIDING IGNITION TIMING ALARM FOR INTERNAL COMBUSTION ENGINE

FIELD OF THE INVENTION

This invention relates to an ignition timing alarm device for an internal combustion engine and, more particularly, to such a device which is capable of avoiding disadvantages created when the vehicle runs at a speed exceeding a preset speed in a state where the ignition timing is controlled to be a fixed ignition timing.

BACKGROUND OF THE INVENTION

The required ignition timing for an internal combustion engine is different, depending on various conditions such as driving state, air fuel ratio of an air-fuel mixture, etc. In order to satisfy such required ignition timing, the internal combustion engine is provided with an ignition timing control unit. There are several known types of ignition timing control units. They include, for example, a centrifugal ignition timing control unit and a vacuum ignition timing control unit which mechanically control the ignition timing by directly introducing with transmission means ignition timing control factors such as the number of engine revolutions (engine speed), inlet pipe pressure, and the like, and an electronic ignition timing control unit which electronically controls the ignition timing by introducing ignition timing control factors such as the number of engine revolutions, inlet pipe pressure, and so forth using detection devices producing electric signals.

The electronic ignition timing control unit usually effects control stabilizing the number of idle rotations in order to maintain the number of engine revolutions to a predetermined number of idle rotations at the idle driving time of the internal combustion engine. This control for stabilizing the number of idle rotations is effected by implementing a spark advance or a spark delay from a specified ignition timing when the actual number of engine revolutions varies from a predetermined number of idle rotations due to fluctuation of the air-fuel ratio or the like during the idle driving of the internal combustion engine. In particular, when the actual number of engine revolutions drops below the predetermined number of idle rotations, the ignition timing is controlled to be spark advanced by about 1°-2°. On the other hand, when the actual number of engine revolutions exceeds the predetermined number of idle rotations, the ignition timing is controlled to be spark delayed. By this, the number of engine revolutions is maintained substantially at the predetermined number of idle rotations during the idle driving time of the internal combustion engine.

In this way, when the control for stabilizing the number of idle rotations is performed by the electronic ignition timing control unit, if initialization of the ignition timing during the idle driving time of the internal combustion engine is to be performed as in the centrifugal ignition timing control device and the vacuum ignition timing control device, the ignition timing fluctuates within a range of ±2°, which makes it difficult to perform the initialization.

In view of the above, another known approach is to provide a fixed ignition switch serving as a fixed ignition timing command signal input arrangement for inputting a fixed ignition timing command signal. This fixed ignition switch is turned on to input the fixed ignition timing command signal, thereby stopping the control to stabilize the number of idle rotations and causing the ignition timing to be controlled to be the fixed ignition timing. By this, the ignition timing can be controlled during maintenance to be the fixed ignition timing by turning on the fixed ignition timing switch and, in the state where the ignition timing is controlled to be the fixed ignition timing, the initialization of the ignition timing is performed during the idle driving time of the internal combustion engine.

However, if turning off of the fixed ignition timing switch is overlooked by careless mistake or the like after initialization of the ignition timing during the idle driving time by switching on of the fixed ignition switch, the vehicle subsequently runs in a state where the ignition timing is controlled to be the fixed ignition timing. As a consequence, since the fixed ignition timing is a very late ignition timing with respect to the ignition timing normally required by the internal combustion engine, there occurs a disadvantage in an internal combustion engine which includes an exhaust emission control device, for example in that catalyst is eluted, thus resulting in deterioration of the function of the emission control device.

It is therefore an object of the present invention to provide an ignition timing alarm device for an internal combustion engine which is capable of avoiding deterioration of the function of the catalyst which occurs when the vehicle runs at a speed exceeding a preset speed in a state where the ignition timing is controlled to a fixed ignition timing in order to perform initialization of the ignition timing during idle driving time of the internal combustion engine.

SUMMARY OF THE INVENTION

In order to attain this object, the present invention provides an ignition timing alarm device for an internal combustion engine which includes an electronic type ignition timing control unit for electronically controlling the ignition timing, and which includes a control arrangement adapted to memorize the input of a fixed ignition timing command signal in order to subsequently issue at a checking time a warning if the vehicle ran at a speed exceeding the preset speed in the state where the ignition timing was controlled to be the fixed ignition timing in accord with the input of a fixed ignition timing command signal.

In accord with the present invention, since the control arrangement memorizes the input of the fixed ignition timing command signal in order to issue at the checking time a warning that the vehicle ran at a speed exceeding the preset speed in the state where the ignition timing was controlled to be the fixed ignition timing due to inputting of the fixed ignition timing command signal, it can be checked whether the vehicle ran at a speed exceeding the preset speed in the state where the ignition timing was set to the fixed ignition timing.

BRIEF DESCRIPTION OF THE DRAWINGS

FIGS. 1 and 2 show a preferred embodiment of the present invention, FIG. 1 being a block diagram showing the construction of an ignition timing alarm device embodying the present invention, and FIG. 2 being a flowchart of a control sequence for the device of FIG. 1.

DETAILED DESCRIPTION

Figure 1:
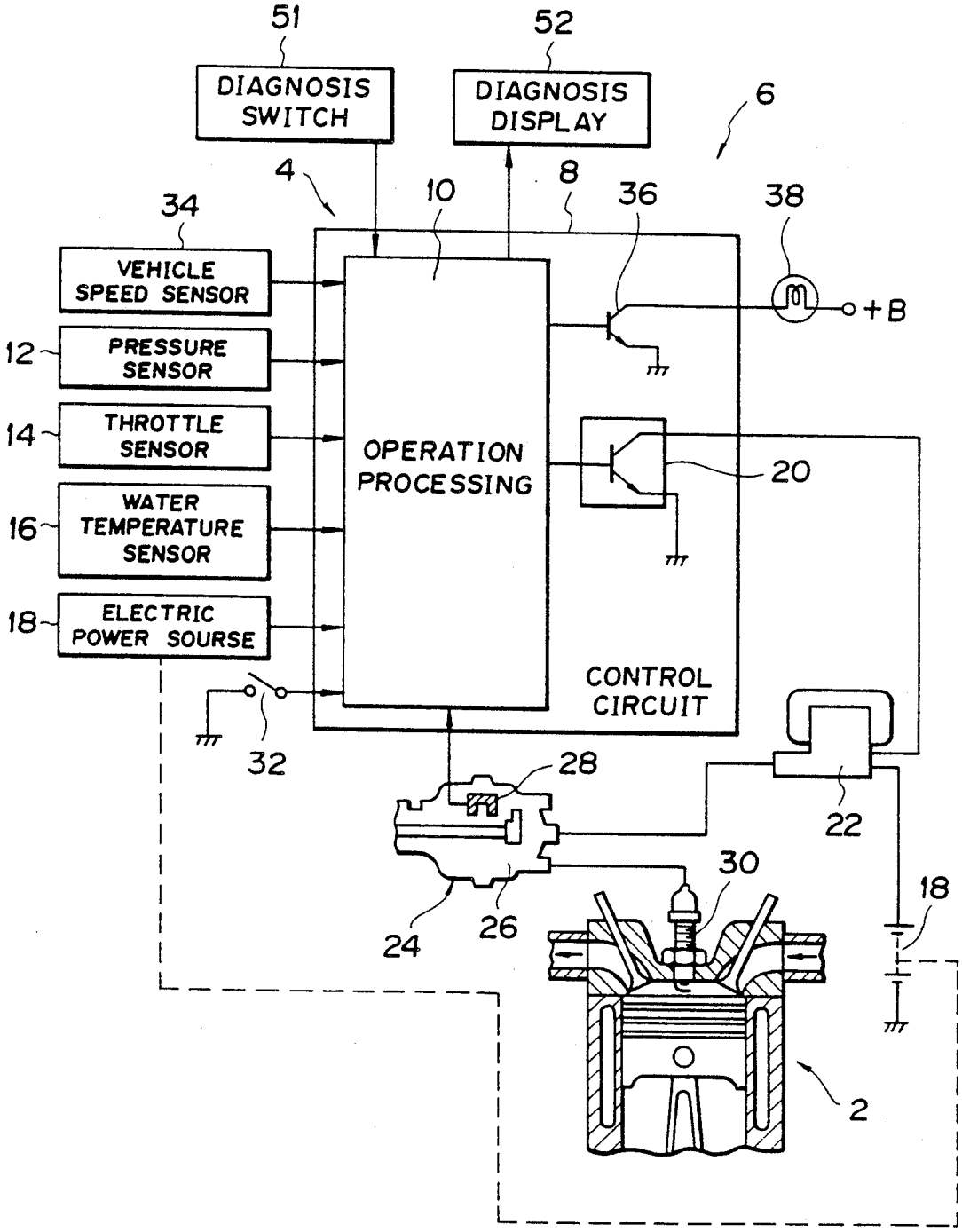

FIGS. 1 and 2 show a preferred embodiment of the present invention. In FIG. 1, reference numeral 2 denotes an internal combustion engine, 4 an electronic ignition timing control device, and 6 an ignition timing alarm device. The electronic ignition timing control device or electronic control unit (ECU) 4 electronically controls the ignition timing of the internal combustion engine 2, and has a control portion 8 which includes a not-illustrated random access memory (RAM). An operation processing portion 10 of the control portion 8 is connected on its input side with a pressure sensor 12 for detecting an engine manifold pressure, a throttle sensor 14 for detecting the opening degree of a throttle valve (not shown) of the engine, various sensors for inputting ignition timing control factor signals such as a water temperature sensor 16 for detecting a circulating water temperature, and an electric power source 18. Also, the operation processing portion 10 is connected on its output side with an ignition coil 22 through a drive circuit 20. The ignition coil 22 connects the electric power source 18 to a distributor 24. The distributor 24 has a distributing portion 26 and an angle of rotation sensor 28. The distributing portion 26 is connected to an ignition spark plug 30. The angle of rotation sensor 28 is connected to the input side of the operation processing portion 10.

In the foregoing arrangement, the electronic ignition timing control device 4 calculates in its operation processing portion 10 in a conventional manner the ignition timing required by the internal combustion engine 2 in accord with the ignition timing control factor signals which are input from the various sensors 12–16 and 28, and then it controls the drive circuit 20 to drive the ignition coil 22 at the calculated ignition timing, which effects a spark to the ignition spark plug 30 through the distributing portion 26 to ignite the air fuel mixture for combustion.

The control portion 8 is connected on the input side of the operation processing portion 10 with a fixed ignition switch 32 serving as a fixed ignition timing command signal input device for inputting the fixed ignition timing command signal to effect control at the fixed ignition timing, and with a vehicle speed sensor 34 for detecting the vehicle speed. The operation processing portion 10 is connected on its output side with a diagnosis lamp 38 serving as a warning light through a drive transistor 36. The foregoing constitutes the ignition timing alarm device 6.

The ignition timing alarm device 6, through the control portion 8 connected with the fixed ignition switch 32 and the vehicle speed sensor 34, sets the ignition timing to the fixed ignition timing in accord with the fixed ignition timing command signal which is input by turning on the fixed ignition switch 32, and lights up the diagnosis lamp 38. In this control portion 8, the input of the fixed ignition timing command signal is memorized irrespective of the subsequent cessation of such signal, in order to issue a warning, if the vehicle ran at a speed exceeding a preset vehicle speed $V_H$ (for example 40 km/hr) in a state where the ignition timing was controlled to be the fixed ignition timing, at a subsequent checking time as a result of turning on a diagnosis switch 51.

The diagnosis switch 51, when turned on, serves to display on a display arrangement 52 a code representation of problematical points which are required to be subjected to maintenance when maintenance work is carried out.

The diagnosis display arrangement 52 can be a conventional LED or LCD display, or could be a CRT display. The switch 51 and display 52 are shown in FIG. 1 as being directly connected to the operation processing portion 10, but could alternatively be parts of a separate remote diagnosis system which is detachably connected to the operation processing portion 10 by a cable when diagnostic procedures are to be performed.

Next, the operation of the disclosed system will be described with reference to FIG. 2.

The control starts at 100, and it is first determined at 101 whether the fixed ignition switch 32 is turned on. If the fixed ignition switch 32 is in its off position, then at 102 a conventional routine having nothing to do with the present invention is carried out while control using normal ignition timing is effected. If the fixed ignition switch 32 is found to be in its on position at 101, the diagnosis lamp 38 is lighted up at 103. If the diagnosis switch 51 is turned on when this diagnosis lamp 38 is lighted up, the fixed ignition code is displayed on display 52 at 104.

That is, in the first stage, even if turning off of the fixed ignition switch did not occur due to careless mistake or the like after initialization of the ignition timing is performed during the idle driving time of the internal combustion engine 2 in the state where the ignition timing is controlled to be the fixed ignition timing due to turning on of the fixed ignition switch 32, while maintenance work is in progress it can be known from the lighting of the diagnosis lamp 38 that a problem occurred regarding the driving of the internal combustion engine 2 and maintenance work is required for it. Based on this, the maintenance work is effected and there can be known the state where the ignition timing is controlled to be the fixed ignition timing from the display of the fixed ignition code through the checking by turning on the not-illustrated diagnosis switch during the maintenance, and the fixed ignition switch 32 can be turned from its on to its off position.

Consequently, it is possible to avoid having the vehicle run in the state where the ignition timing is controlled to be the fixed ignition timing. In the internal combustion engine 2, which includes an exhaust emission control device, there can thus be avoided the deterioration of its function due to elution of the catalyst or the like, thus enabling engine performance to be maintained.

If the vehicle starts moving in the state where the diagnosis lamp 38 has been lighted up at step 103, and if the diagnostic switch 51 is off, it is determined at 105, as the second stage and using the vehicle speed sensor 34, whether the vehicle ran at a speed exceeding a preset vehicle speed $V_H$ (for example, 40 km/h) in the state where the ignition timing was controlled to the fixed ignition timing due to input of the fixed ignition timing command signal caused by turning on of the fixed ignition switch 32. If the vehicle did not run at a speed exceeding the preset vehicle speed $V_H$ in the state where the fixed ignition switch 32 was turned on, at 106 the fixed ignition code is not stored in the control portion 8 nor memorized. On the other hand, if the vehicle ran at a speed exceeding the preset vehicle speed $V_H$ in the state where the fixed ignition switch 32 was turned on, control goes to the next (third) stage at 107. In a conventional manner, the lighting of the diagnosis lamp 38 indicates that some problems have occurred to the driving state of the internal combustion engine and the code representation of the problematical point which is required to be subjected to maintenance is normally memorized in the control portion 8. This code requirement is kept memorized even if the ignition switch 32 is turned off, because the electric power source 18 is coupled directly to the control portion 8. Therefore, there can be known the existence of the problematical point from the display of the memorized code representation by turning on the diagnosis switch during maintenance.

However, although the fixed ignition code of the present invention is displayed by lighting up the diagnosis lamp 38 and by turning on the diagnosis switch, when maintenance is performed due to the lighting of the diagnosis lamp 38 and the fixed ignition switch 32 is turned from its on to its off position, the diagnosis lamp 38 is turned off and the fixed ignition code is no longer stored or memorized.

That is, even if the vehicle runs in the state where the ignition timing is controlled to be the fixed ignition timing, when the vehicle speed does not exceed the preset vehicle speed $V_H$, there is no fear of creating deterioration of the emission control function due to elution of the catalyst or the like. Accordingly, in the second stage, when the fixed ignition switch 32 is turned from its on to its off position, the diagnosis lamp 38 is turned off and the fixed ignition code is not stored in the control portion 8 or memorized.

If the vehicle ran at a speed exceeding the preset vehicle speed $V_H$ in the state where the fixed ignition switch 32 was turned on in step 105, the input of the fixed ignition timing command signal is memorized at 107 (the third stage) irrespective of cessation of the fixed ignition timing command signal caused by turning off the fixed signal switch 32. In this case, the fixed ignition code is memorized. Even if the ignition switch is turned off to stop the internal combustion engine, this fixed ignition code remains memorized as long as the connected relation with the electric power source 18 is not cancelled.

Consequently, if it is detected by the vehicle speed sensor 34 that the vehicle ran at a speed exceeding the preset vehicle speed $V_H$ in the state where the ignition timing was controlled to be the fixed ignition timing in accord with the input of the fixed ignition timing command signal caused by turning on the fixed ignition switch 32, since the fixed ignition code is memorized even if the ignition switch is turned off in the third stage, the memorized fixed ignition code can be displayed by turning on the diagnosis switch during maintenance. Based on this fixed ignition code, it can be known, through the issuance of the warning, that the vehicle ran at a speed exceeding the preset vehicle speed $V_H$ in the state where the ignition timing was controlled to be the fixed ignition timing, by turning on the diagnosis switch 51 during maintenance.

As a consequence, in the internal combustion engine 2 which includes an exhaust emission control device, there can be a later inspection for any deterioration of the function of the catalyst due to the vehicle running in the state where the ignition timing was controlled to be the fixed ignition timing. After 107, control goes to END at 109. By this, the engine performance can be maintained.

In this way, according to the present invention, by virtue of the provision of the control arrangement adapted to memorize the input of a fixed ignition timing command signal in order to issue a warning that the vehicle ran at a speed exceeding the preset speed in the state where the ignition timing was controlled to be the fixed ignition timing at a checking time, when the vehicle ran at a speed exceeding a preset speed in a state where the ignition timing was controlled to a fixed ignition timing in accordance with the input of a fixed ignition timing command signal, it can be detected that the vehicle ran at a speed exceeding the preset vehicle speed in the state where the ignition timing was controlled to the fixed ignition timing.

Accordingly, in the internal combustion engine which includes an exhaust emission control device, there can be an inspection for the occurrence of deterioration in the function of the catalyst due to the vehicle running in the state where the ignition timing is controlled to the fixed ignition timing. By this, engine performance can be maintained.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. In an ignition timing alarm device for an internal combustion engine which includes an electronic ignition timing control means for electronically controlling the ignition timing, the improvement comprising control means for memorizing the input of a fixed ignition timing command signal in order to subsequently issue a warning at a checking time if the vehicle ran at a speed exceeding a present speed in a state where the ignition timing was controlled to be the fixed ignition timing in accord with the input of the fixed ignition timing command signal, wherein during said fixed ignition timing ignition pulses are fixedly synchronized to rotation of a rotating part of said engine.

2. An apparatus for controlling ignition timing of an engine of a vehicle, comprising: selectively actuable fixed timing means for forcing the ignition timing of said engine to a fixed ignition timing in response to a first predetermined condition, wherein during said fixed ignition timing ignition pulses are fixedly synchronized to rotation of a rotating part of said engine; means for monitoring the speed of said vehicle and detecting a situation in which the speed of said vehicle exceeds a preset speed while said fixed timing means is actuated and is forcing the ignition timing to said fixed ignition timing, and for storing in a memory device in response to detection of said situation an indication that said situation has occurred; and means for thereafter displaying in response to a second predetermined condition a warning if said indication that said situation occurred is present in said memory device.

3. An apparatus as recited in claim 2, including a fixed ignition switch and a diagnosis switch, said first predetermined condition being actuation of said fixed ignition switch and said second predetermined condition being actuation of said diagnosis switch.

4. A method of comprising the steps of:

forcing an ignition timing for an engine of a vehicle to a fixed ignition timing in response to a first predetermined condition, wherein during said fixed ignition timing ignition pulses are fixedly synchronized to rotation of a rotating part of said engine;

checking for a situation in which the speed of the vehicle exceeds a preset speed while said fixed ignition timing is being used for the engine, and for storing in a memory device an indication that said situation occurred; and thereafter displaying in response to a second predetermined condition a warning if said indication that said situation occurred is present in said memory device.

* * * * *